United States Patent [19]

Child

[11] Patent Number: 4,812,431

[45] Date of Patent: Mar. 14, 1989

[54] NOX CONTROL IN FLUIDIZED BED COMBUSTION

[75] Inventor: Jonathan E. Child, Sewell, N.J.

[73] Assignee: Mobil Oil Corporation, New York, N.Y.

[21] Appl. No.: 84,243

[22] Filed: Aug. 12, 1987

[51] Int. Cl.[4] ..... B01J 38/36; R01J 29/38; C10G 11/18; C01B 21/20

[52] U.S. Cl. ..... 502/42; 208/113; 208/120; 208/164; 423/235; 502/21; 502/41

[58] Field of Search ..... 502/41, 42, 21, 515; 208/164; 423/235

[56] References Cited

U.S. PATENT DOCUMENTS

| | | | |
|---|---|---|---|
| 3,808,121 | 4/1974 | Wilson, Jr. | 502/42 |
| 3,893,812 | 7/1975 | Conner et al. | 208/164 |
| 4,180,454 | 12/1979 | Luckenbach | 502/42 |
| 4,197,189 | 4/1980 | Thompson et al. | 208/164 |
| 4,199,435 | 4/1980 | Chessmore et al. | 208/113 |
| 4,222,856 | 9/1980 | Hansel et al. | 208/164 |
| 4,235,704 | 11/1980 | Luckenbach | 208/113 |
| 4,300,997 | 11/1981 | Meguerian et al. | 208/120 |
| 4,309,309 | 1/1982 | Blanton, Jr. | 208/120 |
| 4,313,848 | 2/1982 | Scott | 208/113 |
| 4,325,833 | 4/1982 | Scott | 208/164 |
| 4,341,623 | 7/1982 | Bertolacini | 502/42 |
| 4,350,615 | 9/1982 | Meguerian et al. | 252/455 |
| 4,542,114 | 9/1985 | Hegarty | 502/39 |

*Primary Examiner*—Paul E. Konopka

*Attorney, Agent, or Firm*—Alexander J. McKillop; Charles J. Speciale; Richard D. Stone

[57] ABSTRACT

Coke is removed from particulate catalyst by passing the coke-containing catalyst into a regenerator containing a fluidized dense bed of catalyst. An oxygen containing gas is added to the regenerator to burn coke from catalyst. The dense bed has a reducing atmosphere in its lower half because most of the CO promoter catalyst present in the regenerator is in the upper half of the dense bed. Nitrogen oxides formed during coke combustion are at least partially reacted to form free nitrogen in the CO-rich atmosphere within the lower-half of the regenerator dense bed. A CO combustion promotor, e.g., platinum on alumina, having a low density, or small size is preferred as it concentrates near the upper portion of the regenerator dense bed. The process is especially useful in FCC regenerators for minimizing the $NO_x$ content of the flue gas, however, it is applicable to any fluidized bed combustion process.

3 Claims, 2 Drawing Sheets

NOX CONTROL IN FLUIDIZED BED COMBUSTION

BACKGROUND OF INVENTION

1. Field of the Invention

The invention relates to a method and apparatus for controlling nitrogen oxide emissions from flue gases generated during fluidized bed combustion, and especially during regeneration of spent FCC catalyst.

2. Description of the Prior Art

Catalytic cracking of hydrocarbons is carried out in the absence of externally supplied $H_2$, in contrast to hydrocracking, in which $H_2$ is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425° C.–600° C., usually 460° C.–560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off, restoring catalyst activity and simultaneously heating the catalyst to, e.g., 500° C.–900° C., usually 600° C.–750° C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts work best when the amount of coke on the catalyst after regeneration is relatively low. It is desirable to regenerate zeolite catalysts to as low a residual carbon level as is possible. It is also desirable to burn CO completely within the catalyst regenerator system to conserve heat and to minimize air pollution. Heat conservation is especially important when the concentration of coke on the spent catalyst is relatively low as a result of high catalyst selectivity. Among the ways suggested to decrease the amount of carbon on regenerated catalyst and to burn CO in the regenerator is to add a CO combustion promoter metal to the catalyst or to the regenerator. Metals have been added as an integral component of the cracking catalyst and as a component of a discrete particulate additive, in which the active metal is associated with a support other than the catalyst. U.S. Pat. No. 2,647,860 proposed adding 0.101 weight percent chromic oxide to a cracking catalyst to promote combustion of CO. U.S. Pat. No. 3,808,121, incorporated herein by reference, introduced relatively large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator. Oxidation-promoting metals such as cobalt, copper, nickel, manganese, copper-chromite, etc., impregnated on an inorganic oxide such as alumina, are disclosed.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory.

Some cracking operations using CO combustion promoters generate nitrogen oxides ($NO_x$) in the regenerator flue gas. It is difficult in a catalyst regenerator to completely burn coke and CO in the regenerator without increasing the $NO_x$content of the regenerator flue gas.

Although many refiners have recognized the problem of $NO_x$ emissions from FCC regenerators, the solutions proposed have not been completely satisfactory. The approaches taken so far have generally been directed to special catalysts which will inhibit the formation of $NO_x$ in the FCC regenerator, or to process changes which reduce $NO_x$ emissions from the regenerator.

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to $CO_2$, while minimizing the formation of $NO_x$.

Another catalyst development is disclosed in U.S. Pat. No. 4,199,435 which suggests steam treating conventional metallic CO combustion promotor to decrease $NO_x$ formation without impairing too much the CO combustion activity of the promoter.

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above from U.S. Pat. No. 4,300,997 U.S. Pat. No. 4,542,114, are incorporated herein by reference.

In addition to the above patents, there are myriad patents on treatment of flue gases containing $NO_x$. The flue gas might originate fron FCC units, or other units. U.S. Pat. No. 4,521,389 and U.S. Pat. No. 4,434,147 disclose adding $NH_3$ to $NO_x$ containing flue gas and catalytically reduce the $NO_x$ to nitrogen.

None of the approaches described above provides the perfect solution. Process approaches which reduce $NO_x$ emissions require extensive rebuilding of the FCC regenerator.

Various catalytic approaches, eg. use of bi-metallic CO combustion promoters, provide some assistance, but the cost and complexity of a bi-metallic combustion promoter is necessary. The reduction in $N_x$ emissions achieved by catalytic approaches helps some but still may fail to meet the ever more stringent $NO_x$ emissions limits set by local governing bodies. Much of the $NO_x$ formed is not the result of combustion of $N_2$ within the FCC regenerator, but rather combustion of nitrogen-containing compounds in the coke entering the FCC regenerator. Bi-metallic combustion promoters are probably best at minimizing $NO_x$ formation from $N_2$.

I have discovered a way to overcome most of the deficiencies of the prior art methods of reducing $NO_x$ emissions from an FCC regenerator. I use conventional CO combustion promoter metals in an unconventional way. By segregating most of the CO combustion promoter within the upper portion of an FCC regenerator dense bed I significantly reduce $NO_x$ emissions while maintaining satisfactory CO combustion. The approach was, in a sense, to turn the teaching of U.S. Pat. No. 3,808,121 upside down. The '121 patent added large-sized particles containing a CO combustion-promoting metal into an FCC regenerator. These particles because of their size and weight congregated at the bottom of the FCC regenerator dense bed. Withdrawal of hot regenerated catalyst occurred from an upper level of the FCC regenerator dense bed, so only the small-sized FCC catalyst cycled back and forth between the reactor.

In my process it is irrelevant whether or not the CO combustion promoter enters the cracking reactor, while it is essential that the CO combustion promoter concentrate at the top of the bed of the FCC regenerator.

SUMMARY OF THE INVENTION

Accordingly, the present invention provides in a fluidized combustion process wherein oxygen or an oxygen-containing gas is added to a single, dense phase fluidized bed of particles containing an upper half and a lower half, a CO combustion promoter is uniformly distributed in the dense bed, a cmbustible substance is burned in the dense bed to produce heat and a flue gas containing $CO_2$ and $NO_x$ resulting from combustion, the improvement comprising maintaining a majority of the CO combustion promoter in the upper one-half of the dense bed, maintaining a reducing atmosphere in the lower one-half of the dense bed and converting therein at least a portion of the $NO_x$ to nitrogen in the reducing atmosphere.

FCC FEED

Figure 2:
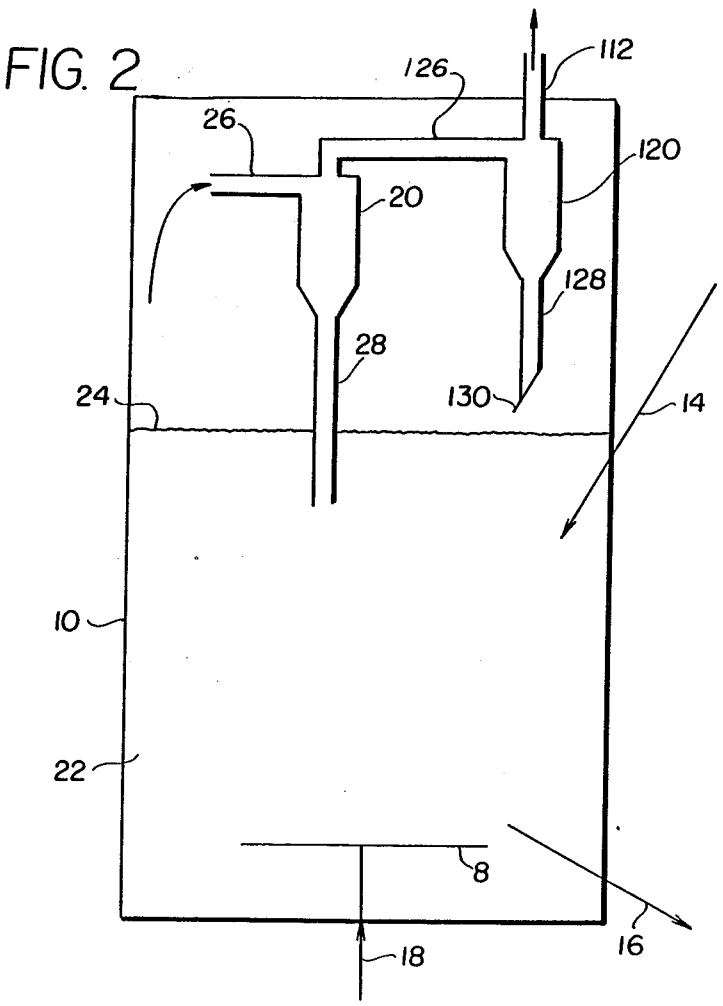
FIG. 2 is a simplified schematic diagram of a modified FCC regenerator of the present invention.

Any conventional FCC feed can be used. The process of the present invention also makes it possible to use charge stocks which are relatively high in nitrogen content, and which otherwise might result in unacceptable $NO_x$ emissions in conventional FCC units. The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

FCC CATALYST

Any conventional FCC catalyst may be used. The catalyst can be 100% amorphous, but preferably includes some zeolite in a porous refractory matrix such as silica-alumina, clay, or the like. The zeolite is usually 5–35 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The catalyst may also contain one or more shape selective zeolites, i.e., those having a Constraint Index of 1–12, and typified by ZSM-5, and other materials having a similar crystal structure.

Relatively high silica zeolite containing catalysts are preferred for use in the present invention. They withstand the high temperatures usually associated with complete combustion of CO to $CO_2$ within the FCC regenerator.

The FCC catalyst composition, per se, forms no part of the present invention.

FCC REACTOR CONDITIONS

Conventional FCC reactor conditions may be used. These conditions include catalyst/oil ratios of 0.5:1 to 15:1 and preferably 3:1 to 8:1, and a catalyst/oil contact time of 0.5–50 seconds, and preferably 1–20 seconds.

The FCC reactor conditions, per se, are conventional and form no part of the present invention.

FLUID BED COMBUSTION ZONES

The invention can be used in any fluidized bed combustion zone such as fluidized bed coal combustion, burning low BTU gas in a fluidized bed, etc. It is especially useful in FCC regenerators.

FCC REGENERATOR CONDITIONS

The temperatures, pressures, oxygen flow rates, etc., are within the broad ranges of those heretofore found suitable for FCC regenerators, especially those operating with substantially complete combustion of CO to $CO_2$ within the regeneration zone. Suitable and preferred operating conditions are

| | Broad | Preferred |
|---|---|---|
| Temperature, °F. | 1100–1700 | 1150–1400 |
| Catalyst Residence Time, Seconds | 60–3600 | 120–600 |
| Pressure, atmospheres | 1–10 | 2–5 |
| % Stoichiometric $O_2$ | 100–120 | 100–150 |

CO COMBUSTION PROMOTER

Use of a CO combustion promoter in the regenerator or combustion zone is essential for the practice of the present invention, however, these materials are well-known.

U.S. Pat. No. 4,072,600 and U.S. Pat. No. 4,235,754, the contents of which have been incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. In swirl type regenerators, operation with 1 to 7 ppm Pt commonly occurs. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to $CO_2$ within the FCC regenerator. More CO combustion promoter can be added without undue bad effect-the primary one being the waste of adding more CO combustion promoter than is needed to burn all the CO.

Preferably, the CO combustion promoter is on a support which is readily segregable from the conventional FCC catalyst. Thus, in one preferred embodiment of the present invention, the CO combustion promoter is on a material with about the same density as the FCC catalyst, but of a smaller particle size than the FCC catalyst, so that it tends to congregate in the upper portion of the FCC regenerator bed.

It is also possible, and preferred, to use Pt (or other CO combustion promoter metal) rich additive on particles as large as or larger than the conventional FCC catalyst. The Pt-rich additive should then have a lower density than the conventional FCC catalyst or be supported by mechanical means in the upper portion of the FCC regenerator dense bed.

A possible mechanical approach is to physically implant the CO combustion promoter within the upper portion of the dense bed of the FCC regenerator. Platinum wires, platinum impregnated honeycombs or rods, could be placed in the upper portion of the FCC regenerator dense bed. Great care should be taken to ensure that such permanently implanted devices do not impair good fluidization within the FCC regenerator. The devices should also be sturdy enough to survive months and even years of operation within the severe erosive environment of an FCC regenerator.

The Pt-rich additive may also be in the form of very large particles which are hollow, such as alumina ping pong balls impregnated with platinum. These exotic CO combustion catalysts would be easy to segregate within the upper portion of the FCC regenerator dense bed, but such an approach may involve extra costs for the unusual support materials.

The invention will now be described in more detail with reference to the two figures.

Figure 1:
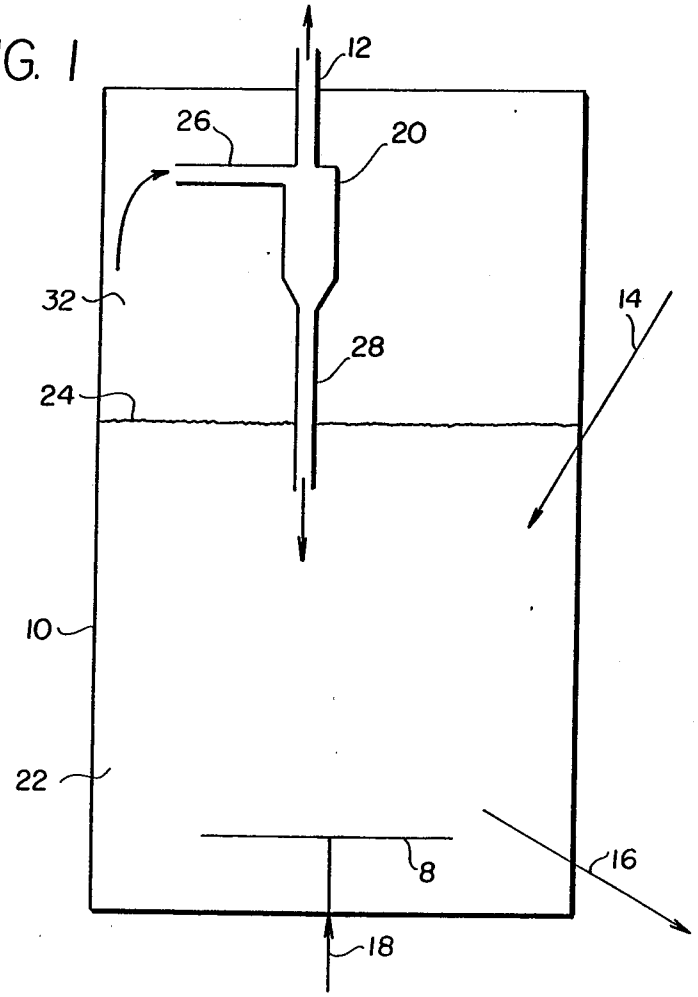
FIG. 1 is a simplified view of a conventional FCC regenerator which can be used in the particle of the present invention.

FIG. 1 shows a conventional FCC regenerator 10 which can be used in the practice of the present invention. First the conventional operation of the FCC regenerator will be discussed, then the process of the invention will be discussed.

Spent catalyst is added to regenerator 10 via line 14. Oxygen containing gas, preferably air, is added via line 18 to conventional air distributor 8 in the lower portion of the regenerator. Coke is burned to CO and $CO_2$ in the dense bed 22 of the regenerator. Spent catalyst 14 will usually have a CO combustion promoter, e.g., an additive of alumina with 1–1000 wt ppm Pt, present in an amount sufficient to add the desired amount, typically 0.1 to 10 ppm Pt to the FCC catalyst inventory. Most of the CO formed in the dense bed is rapidly burned to $CO_2$ in the dense bed. Regenerated catalyst is withdrawn via line 16 for reuse within a conventional FCC reactor, not shown.

The dense bed of catalyst 22 has an upper level 24. Products of combustion, typically $NO_x$, $SO_x$, minor amounts of CO, minor amounts of oxygen, and inerts such as nitrogen, pass from dense bed 22 into dilute phase 32. A significant amount of catalyst fines is usually entrained in the flue gas, so conventionally FCC units pass the flue gas through the inlet 26 of a cyclone 20 to recover entrained catalyst and catalyst fines so that relatively solids-free flue gas can be discharged via line 12. Entrained catalyst and fines removed by cyclone 20 from flue gas are usually discharged through dipleg 28 back into the dense bed of catalyst 22.

Although only a single cyclone is shown in the drawing, commercially most FCC regenerators have quite a few cyclones. Usually there are two sets of cyclones, primary and secondary. A typical FCC regenerator might have eight primary cyclones, each discharging into a secondary cyclone, resulting in 16 cyclones in all. In addition, third or even higher stage cyclones can be used to recover more catalyst and catalyst fines for return to the FCC regenerator. Electrostatic precipitators, porous stainless steel filters, and similar devices can all be used to recover small sized particles and return them to the FCC regenerator.

FIG. 1—INVENTION

The process of the present invention may be implemented into a conventional FCC regenerator such as that of FIG. 1 by adding a CO combustion promoter which tends to rise in the FCC regenerator dense bed. Addition of somewhat smaller sized combustion particles, perhaps in conjunction with use of coarser FCC catalyst, will result in a net migration of CO combustion promoter to the upper portions of the FCC regenerator.

Because of the segregation of CO combustion promoter within the upper portions of the FCC regenerator dense bed, there is less CO combustion promoter in the bottom of the regenerator dense bed, permitting significant concentrations of CO to be present there. Although not all of the carbon monoxide is afterburned to $CO_2$ within the lower portion of the dense bed of the regenerator, most of the coke is removed there. As the coke burns, the nitrogen compounds contained in the coke burn to $NO_x$. The $NO_x$ formed reacts with the CO to form $CO_2$ and $N_2$. Much of the remaining CO is combusted to $CO_2$ within the upper portions of the dense bed of the regenerator, where most of the CO combustion promoter is located.

Further modifications can also be made to optimize operation, e.g., restricting somewhat the amount of air that is added to the bottom of the dense bed regenerator, and optionally adding additional combustion air to the upper portion of the dense bed. This helps ensure that there is a reducing atmosphere in the lower portion of the bed and an oxidizing atmosphere in the upper portion of the regeneration bed. Most of the combustion air should be added to the bottom of the dense bed. When split air addition is practiced, from 1–50% of the total amount of air added can be added to the upper portion of the bed, preferably 3–30%.

A drawback to the approach of FIG. 1 is that reliance solely upon very small particles of CO combustion promoter, or use of a low density CO combustion promoter additive results in somewhat higher losses of CO combustion promoter. This is because a certain portion of the promoter is lost with the flue gas, despite the use of a cyclone separator. Another minor problem with the use of a diplet 28, as shown in the figure, is that a significant amount of the entrained CO combustion promoter returned via the dipleg is swept along with regenerated catalyst back to the FCC reactor, via line 1B. The increased concentration of CO promoter near interface 24 may not be achieved to the extent desired.

FIG. 2 shows some modifications to the FCC regenerator which aid in establishing an increased concentration of CO combustion promoter in the upper portion of the FCC regenerator dense bed.

FIG. 2 shows the addition of a secondary cyclone 120, receiving flue gas via exhaust line 126 from primary cyclone 20. Flue gas, with a substantially reduced content of entrained catalyst and the CO combustion promoter, is removed from the system via line 112. Catalyst, catalyst fines, and CO combustion promoter are discharged from cyclone 120 via dipleg 128 to the upper portion of the dense bed 22. The flapper valve 130 at the bottom of dipleg 128 is a conventional design which allows catalyst particles to leave dipleg 128, but does not allow flue gas to enter the standpipe. A seal pot or flow control valve on the dipleg would accomplish the same thing, prevention of backflow up dipleg 128.

Further modifications of the design shown in FIG. 1 or in FIG. 2 can be made to permit selective recovery of catalyst fines from the primary cyclone exhaust. Extra stages of cyclones, bag filters, porous stainless steel filters, electrostatic precipitators and the like can be used to recover, and preferably recycle, promoter to the dense bed, preferably the upper portion of it. Selective removal of catalyst fines, with a high concentration of CO combustion promoter, also permits regeneration or recovery of the promoter. This can be economically advantageous when platinum or other expensive noble metals are used as CO combustion promoters. It also facilitates rapid change in promoter composition if a refiner wants to go from a mono-metallic promoter to bi-metallic promoter or the reverse.

ILLUSTRATIVE EMBODIMENT

The effects of the invention will be demonstrated by a combination of actual tests and computer simulations. The tests show that it is possible to concentrate low density or relatively fine particles in the upper portions of dense fluidized beds. The computer simulations generate the $NO_x$ conversion expected with CO promoter segregation in a typical FCC regenerator practicing the present invention.

EXAMPLE 1

Floating Large Particles

I experimentally determined that a particle of density about 0.5 g/cc or less will float on fluidized FCC catalyst. Particles up to 0.65 g/cc barely float, and only if they are fairly large (about ½" in diameter or more). These tests were done in a 2" diameter, 10" long bed of commercial catalyst, fluidized with air. The optimum large size particle, and minimum density, will change with FCC regenerator pressure, equilibrium catalyst properties, etc. The large, light particles float, but are not swept out of the dense bed.

EXAMPLE 2

Fines Concentration in Fluidized Beds

Separating by size difference alone is more difficult. With the small size particles used for FCC catalysts, mixing of different size particles is very good. The catalyst segregation I observed in other fluidized bed processes was not that great, and would have less impact on the $NO_x$ emissions. The only way to get the particles to segregate enough by size difference alone is to make the promoter particles so small that they will elutriate at a high rate. The cyclone dipleg can then return the fines near the top of the dense bed where they will preferentially stay prior to elutriation.

EXAMPLE 3

Computer Simulations

This test is based on a commercial FCC regenerator, like the one shown in FIG. 1, computer simulations and estimates. Two extreme modes of operation should be considered:

A. conventional (no promoter segregation)

B. invention with no promoter segregation.

I have no data directly translatable to show concentrations of various size particles throughout the bed achievable under normal FCC regenerator conditions. Based on standard correlations in the literature, CO promoter particle sizes of about 10 microns e.g., 5 to 15 microns would give sufficiently high entrainment rates for segregation to be possible. This is an estimate. The optimum size and density of the CO promoter particle will change from unit to unit, because of changes in cyclone efficiency, equilibrium catalyst properties, and fluidization conditions in the dense and dilute beds.

The FCC reactor operating conditions were:

| | |
|---|---|
| Top temperature | 970° F. |
| Combined Feed Ratio | 1.05 |
| Catalyst to oil ratio | 5.0 |
| Reactor pressure | 28 psig |
| Conversion | 60 vol % |

The feed contained 1600 ppm nitrogen. The FCC regenerator operated with an average dense bed temperature of 1280° F. There was 1.0 volume % $O_2$ in the regenerator flue gas.

Tests were conducted in a commercial FCC unit, operating with a single dense of catalyst in the regenerator. The CO combustion catalyst was uniformly distributed within the regenerator. The flue gas contained 2100 mg/Nm$^3$ of $NO_x$, 70 ppm CO, 1.0 mole % $O_2$ at 7 ppm Pt on catalyst. Other tests were conducted with different levels of Pt, to generate the data represented by FIG. 3.

Figure 3:
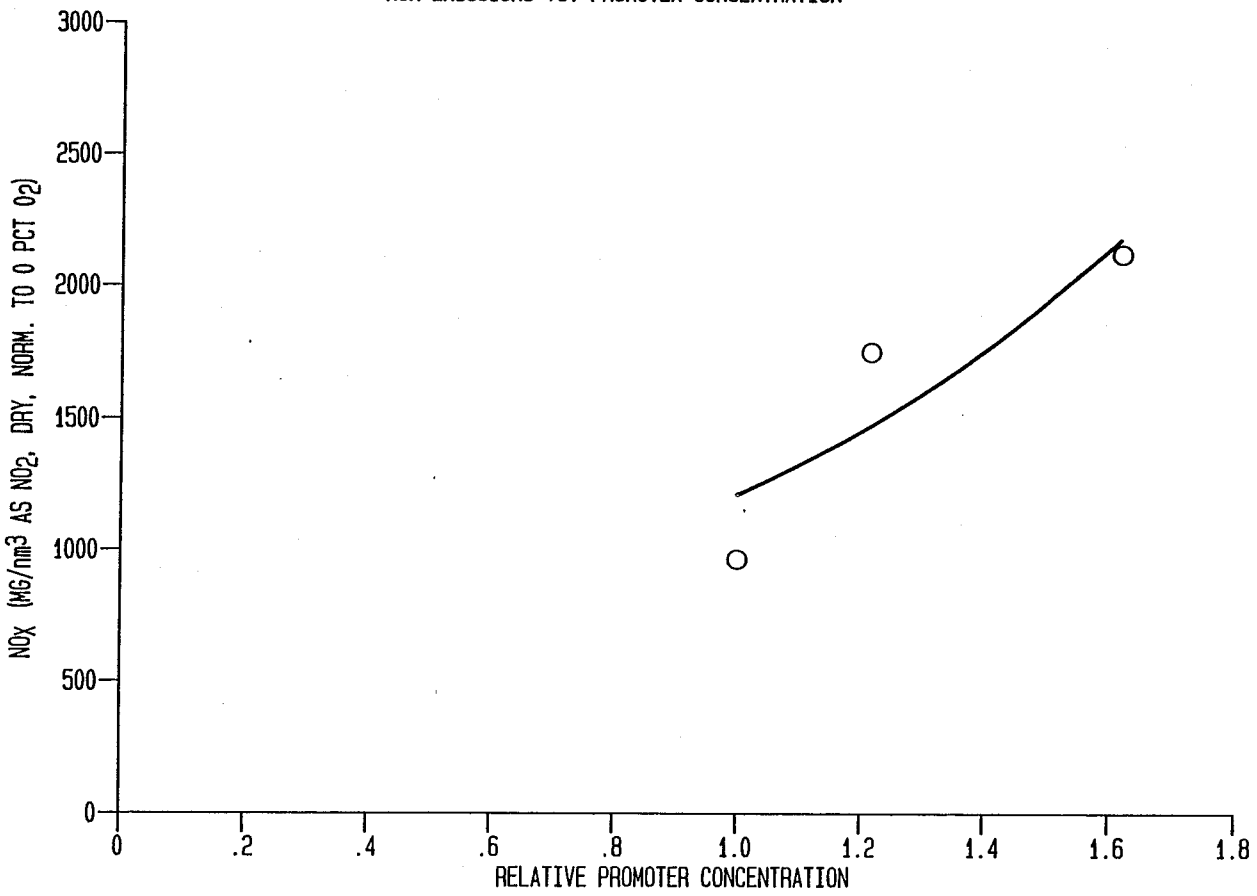
FIG. 3 shows how $NO_x$ emissions vary as a function of relative Pt concentration on FCC catalyst.

FIG. 3 shows how $NO_x$ content of the flue gas depends on Pt concentration in the dense bed. By segregating the Pt in the top of the dense bed, by using catalyst fines with Pt, or floating Pt impregnated balls, the Pt content in the portion of the bed where the $NO_x$ is formed will approach 0 and, according to the graph, $NO_x$ emissions will decrease. For example, reducing the Pt content in the bottom of the bed from 7 ppm to 3 ppm will decrease $NO_x$ from 2100 mg/Nm$^3$ to 900 mg/Nm$^3$. By floating the remaining Pt on the top of the bed, almost complete CO combustion can be maintained while keeping the $NO_x$ levels at a low level associated with lower Pt levels. Althouh the ideal operation would be 100% of the Pt on the top of the dense bed, and none of the bottom half, this is almost impossible to achieve when using conventional CO combustion promoters. The conventional promoters, discussed below, behave much like conventional FCC catalyst.

The CO combustion promoter is a Pt on alumina additive with the properties shown in Table I. These additives, and many more, are commercially available.

TABLE I

| Conventional CO Oxidation Promoters | A | B |
|---|---|---|
| Real Density, g/cc | 2.718 | 2.718 |
| Particle Density, g/cc | 1.597 | 1.619 |

TABLE I-continued

| Conventional CO Oxidation Promoters | A | B |
|---|---|---|
| MSA Particle Size Distribution, % wt | | |
| 0–20 microns | 2.4 | 0.0 |
| 20–40 microns | 12.2 | 13.2 |
| 40–60 microns | 31.7 | 34.2 |
| 60–80 microns | 29.3 | 31.5 |
| 80 + microns | 24.4 | 21.1 |
| Average Particle Size, microns | 62.1 | 61.3 |
| Platinum Promoter Level, ppm | 101 | 431 |
| CO Oxidation Test | | |
| Promoter, g | 0.0240 | 0.0096 |
| Conventional catalyst, g | 19.9760 | 19.9904 |
| Platinum, ppm of mix | 0.121 | 0.207 |

To achieve segregation of CO combustion promoter in the upper portion of the dense bed, the CO combustion promoter would preferably be lighter weight particles.

Using a large, hollow particle it is easy to achieve essentially complete segregation of the CO combustion promoter on top of the dense bed.

A particle distribution was assumed which meshed with that achieved in my fluidized bed test of Example 1. 100% of the CO combustion promoter was assumed to segregate into the upper 10% of the commercial FCC regenerator.

The flue gas $NO_x$ concentration will be less than 750 mg/Nm$^3$, my best estimate is about 500 mg/Nm$^3$.

The reason $NO_x$ emissions can be reduced so much is because most of the coke burns in the lower part of the bed and forms CO. The CO probably reacts with the $NO_x$.

No changes were observed in the commercial FCC reactor/regenerator operation with changes in Pt level that affected the operability of the cracking unit, other than the reduction in $NO_x$ in the flue gas. In practicing the invention the dense bed temperature will be the same, since the same amount of combustion is occurring. Therefore, the catalyst/oil ratio and all other process variables will be essentially unchanged.

BEST MODE

The best mode contemplated for practicing the invention is to incorporate a CO combustion promoter in the form of ½" diameter particles, with a density of about 0.4 g/cm$^3$ into an FCC regenerator. Hollow ceramic tubes or metal tubes sealed at the ends and coated with porous ceramic or refractory could be used. These will float on the dense bed of catalyst. I would carefully control the amount of excess air added, as addition of too much excess air makes it hard to create a reducing atmosphere in the lower portion of the FCC regenerator. Addition of insufficient air would result in increased CO emissions, which could be compensated to some extent by use of more CO combustion promoter.

Preferably 60 to 90% of the CO combustion promoter is in the upper half of the dense bed.

Promoter levels will be about the same, or slightly higher than used conventionally.

What is claimed is:

1. In a fluidized catalytic cracking (FCC) process wherein conventional FCC catalyst contacts conventional FCC feedstock in a conventional FCC reactor to produce cracked products and coked catalyst which is regenerated in a conventional FCC regenerator comprising a single dense bed to which air or an oxygen-containing gas is added to produce a regenerated catalyst and flue gas containing $CO_2$ and $NO_x$ resulting from coke combustion, and wherein carbon monoxide (CO) combustion promoter is uniformly distributed in the catalyst bed to promote complete combustion of CO to $CO_2$, the improvement comprising maintaining a majority of the CO combustion promoter as a solid particle with a volume at least 10 times greater than the conventional FCC catalyst and having a low density, relative to the dense bed density, so that the promoter floats to the top of the regenerator dense bed of FCC catalyst in the FCC regenerator, and maintaining a reducing atmosphere in a lower one-half portion of the dense bed of FCC catalyst in the FCC regenerator and converting in the reducing atmosphere at least a portion of the $NO_x$ formed during coke combustion to nitrogen.

2. The process of claim 1 further characterized in that the CO combustion promoter comprises 0.01 to 50 ppm of platinum group metal or other metal with an equivalent CO oxidation activity, on an elemental metal basis, based on the weight of particles in the regenerator.

3. The process of claim 1 further characterized in that some air of oxygen containing gas is added to the upper one-half of the dense bed in the regenerator.

* * * * *

UNITED STATES PATENT AND TRADEMARK OFFICE

CERTIFICATE OF CORRECTION

PATENT NO. : 4,812,431

DATED : March 14, 1989

INVENTOR(S) : Jonathan E. Child

It is certified that error appears in the above-identified patent and that said Letters Patent is hereby corrected as shown below:

| | |
|---|---|
| Col. 3, line 46 | delete "particle" and insert --practice-- |
| Col. 5, line 61 | after "$SO_x$" insert --$CO_2$-- |
| Col. 8, line 9 | before "promoter" delete "no" |

Signed and Sealed this

Twenty-first Day of November, 1989

*Attest:*

JEFFREY M. SAMUELS

*Attesting Officer* *Acting Commissioner of Patents and Trademarks*